US008702391B2

(12) United States Patent
Bregman et al.

(10) Patent No.: US 8,702,391 B2
(45) Date of Patent: Apr. 22, 2014

(54) GAS TURBINE BLADE

(75) Inventors: Vitaly Bregman, Moskau (RU); Mikhail Petukhovskiy, Moscow (RU)

(73) Assignee: OOO Siemens, Moscow (RU)

( * ) Notice: Subject to any disclaimer, the term of this patent is extended or adjusted under 35 U.S.C. 154(b) by 0 days.

(21) Appl. No.: 13/806,204

(22) PCT Filed: Jun. 22, 2011

(86) PCT No.: PCT/EP2011/060500

§ 371 (c)(1),
(2), (4) Date: Feb. 13, 2013

(87) PCT Pub. No.: WO2011/161188

PCT Pub. Date: Dec. 29, 2011

(65) Prior Publication Data

US 2013/0209268 A1 Aug. 15, 2013

(30) Foreign Application Priority Data

Jun. 23, 2010 (WO) ..... PCT/RU2010/000352

(51) Int. Cl.
*F01D 5/18* (2006.01)

(52) U.S. Cl.
USPC ..... 416/96 R; 416/97 R

(58) Field of Classification Search
USPC ..... 416/97 R, 96 R, 92, 90 R; 415/115
See application file for complete search history.

(56) References Cited

U.S. PATENT DOCUMENTS

| | | | | |
|---|---|---|---|---|
| 4,278,400 | A | 7/1981 | Levengood | |
| 5,873,695 | A * | 2/1999 | Takeishi et al. | 415/115 |
| 6,257,830 | B1 * | 7/2001 | Matsuura et al. | 416/96 R |
| 2006/0133935 | A1 | 6/2006 | Papple | |
| 2010/0068066 | A1 | 3/2010 | Bunker | |

FOREIGN PATENT DOCUMENTS

| | | | |
|---|---|---|---|
| EP | 0939196 | A2 | 9/1999 |
| EP | 1526250 | A2 | 4/2005 |
| EP | 1788195 | A2 | 5/2007 |

* cited by examiner

*Primary Examiner* — Dwayne J White

(57) ABSTRACT

A gas turbine blade including a root and an air foil with a leading edge and a trailing edge, a cooling air channel system extending from a cooling air opening in the root via a winding serpentine channel to a trailing edge channel at the trailing edge including an air outlet at the trailing edge is provided. For efficiently cooling the trailing edge of the blade it is proposed that the cooling air channel system includes an air bypass channel connecting the cooling air opening in the root with the trailing edge channel bypassing the serpentine channel.

12 Claims, 2 Drawing Sheets

FIG 2
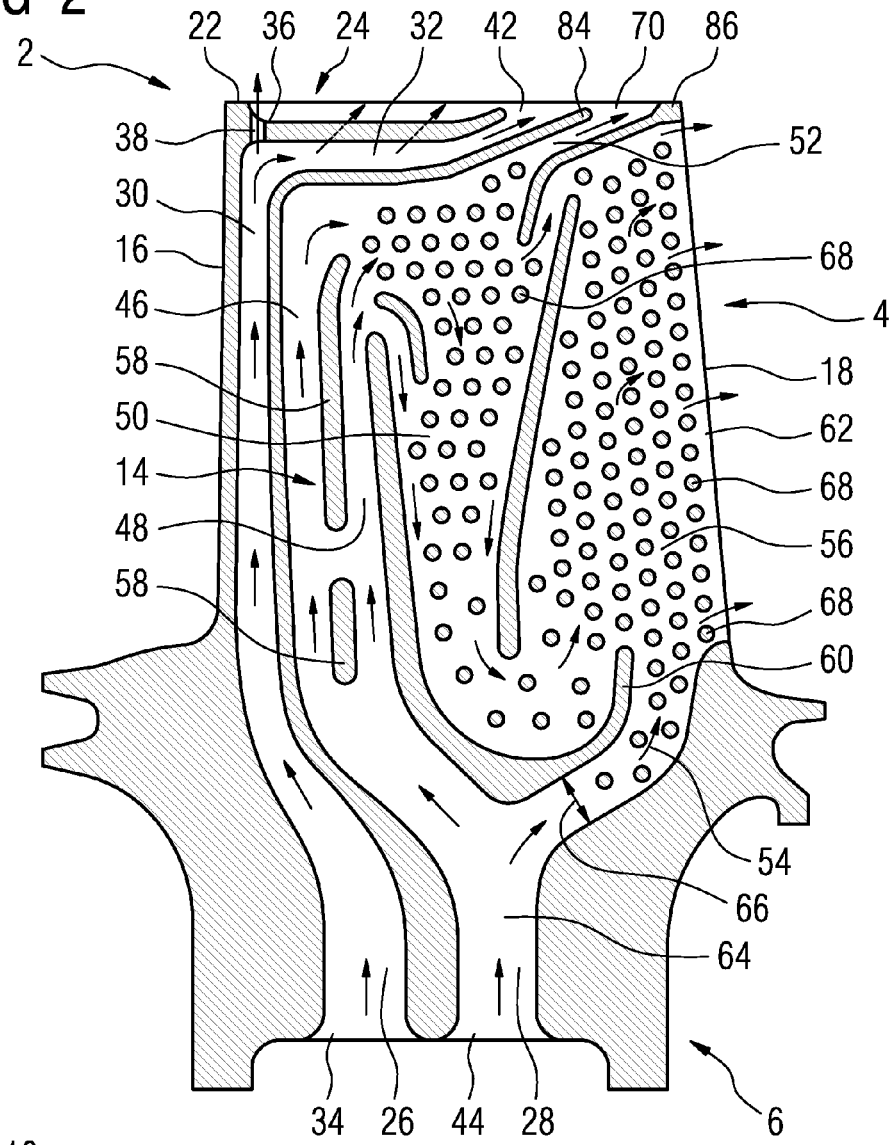
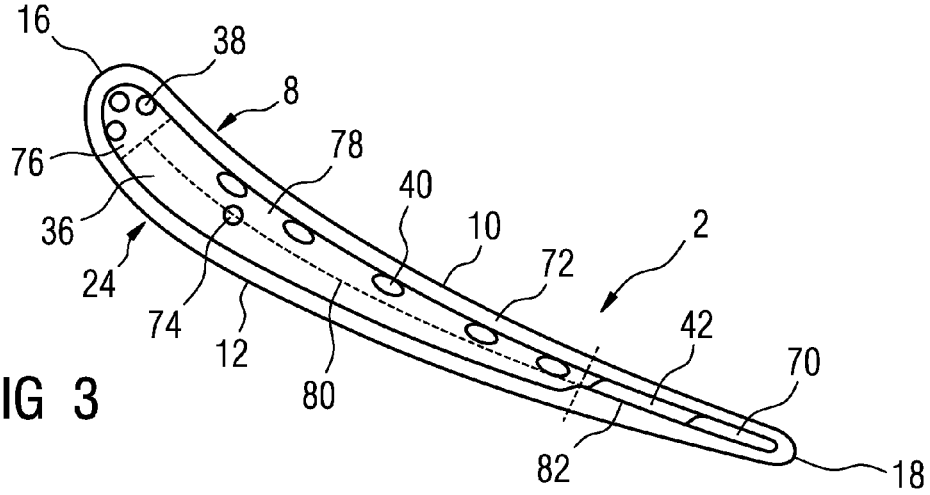
FIG 3

GAS TURBINE BLADE

CROSS REFERENCE TO RELATED APPLICATIONS

This application is the US National Stage of International Application No. PCT/EP2011/060500, filed Jun. 22, 2011 and claims the benefit thereof. The International Application claims the benefits of International application PCT/RU2010/000352 WO filed Jun. 23, 2010. All of the applications are incorporated by reference herein in their entirety.

FIELD OF INVENTION

This invention is directed generally to turbine blades and, more particularly, to a gas turbine blade comprising a root and an air foil with a leading edge and a trailing edge, a cooling air channel system extending from a cooling air opening in the root via a winding serpentine channel to a trailing edge channel at the trailing edge comprising an air outlet at the trailing edge.

BACKGROUND OF THE INVENTION

Gas turbines operate at high temperatures that may reach 1.200° C. and more. Accordingly the turbine blades must be capable of withstanding such high temperatures. For prolonging the life of the blades they often contain cooling systems conducting cooling air through the blade.

A gas turbine blade comprises a root, a platform and an airfoil that extends outwardly from the platform, the airfoil comprising a tip, a leading edge and a trailing edge. During operation of a gas turbine high stresses may be generated in some areas of the turbine blade. Particular life limiting areas are found in the airfoil hub region and the trailing edge region at the hub forming a relatively thin wall on the downstream side of the airfoil. Because of its relatively thin structure and high stresses during operation, the trailing edge is highly susceptible to formation of cracks which may lead to failure of the airfoil.

The cooling system contains internal cooling channels which receive air from the compressor of the gas turbine and pass the air through the blade. The cooling channels include multiple flow paths that are designed to maintain the turbine blade at a relatively uniform temperature. However, centrifugal forces and air flow at boundary layers sometimes prevent some areas of the turbine blade from being adequately cooled, resulting in the formation of localized hot spots which can reduce the lifetime of a turbine blade.

A cooling system in the airfoil may include cooling air passages to maximize convection cooling in the airfoil tip and trailing edge, and discharge a portion of the cooling air through cooling holes in the tip and trailing edge of the airfoil. Such turbine blade is known, for instance, from U.S. Pat. No. 4,278,400.

SUMMARY OF THE INVENTION

It is an object of the invention to provide a gas turbine blade with a high cooling capability in the trailing edge portion of the airfoil.

This object is solved in accordance with the invention by a gas turbine blade as mentioned above, wherein the cooling air channel system comprises an air bypass channel connecting said cooling air opening in the root with the trailing edge channel bypassing the serpentine channel.

Operation of a turbine engine results in high stresses being generated in numerous areas of a turbine blade. One particular area of high stress is found in the airfoil trailing edge, which is a portion of the airfoil forming a relatively thin edge. Because the trailing edge is relatively thin and an area prone to development of high stresses during operation, the trailing edge is highly susceptible to formation of cracks which may lead to failure of the airfoil. With the bypass channel cool air coming from the opening in the root is led directly to the trailing edge channel without being heated in a radial channel or a serpentine channel thus cooling the trailing edge very efficiently.

Cooling air is supplied to the interior of the airfoil via an opening in the radial inner side of the root. Such a root may have more than one opening. As known, one opening may supply air to a serpentine channel and further to the trailing edge channel and another opening may supply air directly to the trailing edge channel serving as a bypass. However, if one of the openings is used for supplying air to a leading edge region only one opening is left which may be used for supplying air to the trailing edge region or channel. The invention proposes a beneficial solution especially for blades with more than one openings, especially only two openings, only one of which supplying air to the trailing edge. This one opening is used for supplying the serpentine channel as well as the bypass channel, efficiently cooling the outer wall of the blade and the trailing edge.

The trailing edge channel may be running parallel to the trailing edge of the blade opening directly to one or more outlets in the trailing edge or a region around the trailing edge.

In accordance with one aspect of the invention the narrowest width of the bypass is at least 10% of the chord width of the air foil thus the distance between the leading edge 16 and the trailing edge 18, especially the chord width close to a platform forming the top of the root. When feeding the bypass channel and the serpentine channel from the same opening in the root, it should be paid attention to the fact that enough cooling air is supplied via the bypass channel. The bypass channel should therefore by large in hydraulic diameter, especially between 10% and 15%, of the chord width of the air foil. The width may be the distance between walls bordering the bypass channel, especially in the plane extending from the leading edge to the trailing edge.

For the same reason it is advantageous if the narrowest width of the bypass is more than half the width of the cooling channel from which the bypass channel branches.

In accordance with another aspect of the invention the cooling air channel system comprises a root channel located at least partially in the root, the bypass channel branching inside the root from the root channel. Since the heating of the air inside the root is fairly low this embodiment ensures that bypass air is cool when reaching the trailing edge channel. The root channel may extend from the opening in the root to a radial channel further downstream than the bypass branch.

If the bypass channel is located with at least half of its length inside the root, especially radially inward of a platform of the blade, heating of the blade in the bypass channel area is kept low ensuring efficient cooling of the trailing edge.

In another embodiment of the invention pedestals are located in the bypass channel, the pedestals being surrounded by cooling air running through the bypass channel. Heat from regions to be cooled may be efficiently transferred to the cooling air. The pedestals may connect the pressure side wall with the suction side wall of the air foil or may only be connected to one of the walls protruding into the bypass channel.

If the trailing edge channel into which the bypass opens comprises pedestals at least in the area of the bypass opening a continuous air flow for uniform cooling of the trailing edge may be achieved.

For the same reason it is preferable if the number of pedestals per area, i.e. the blockage effect is the same in the bypass channel and the trailing edge channel. Moreover, it is preferable if the pedestals in the bypass channel and in the trailing edge channel are of the same type. Especially they have the same shape and size.

Efficient cooling of the trailing edge may be achieved, if the bypass opens directly to the trailing edge. This is the case if the distance between the opening of the bypass channel into the trailing edge channel to the closest air outlet in the trailing edge and/or of the trailing edge channel is less than three times the narrowest width of the bypass channel in the plane connecting the trailing edge with the leading edge.

In a further embodiment of the invention the bypass opens into the trailing edge channel in radial direction from the root to the tip. Due to the rotation of the blade a radial force acts on cooling air flowing through the bypass channel. With a radial opening the flow is supported, ensuring a sufficient flow of cooling air through the bypass channel.

BRIEF DESCRIPTION OF THE DRAWINGS

While the specification concludes with claims particularly pointing out and distinctly claiming the present invention, an embodiment of the invention will now be described, by way of example only, with reference to the accompanying drawings, wherein:

FIG. 2 shows a cross-sectional view of the turbine blade with channels for leading cooling air through the airfoil, and FIG. 3 shows a view top down on the tip of the airfoil.

Referring to FIG. 1, an exemplary turbine blade 2 for a gas turbine engine is illustrated. The blade 2 includes an airfoil 4 and a root 6 which is used to conventionally secure the blade 2 to a rotor disk of the engine for supporting the blade 2 in the working medium flow path of the turbine where working medium gases exert motive forces on the surfaces thereof. With reference to FIG. 1 and FIG. 2 the airfoil 4 has an outer wall 8 surrounding a hollow interior 14. The airfoil outer wall 8 comprises a generally concave pressure sidewall 10 and a generally convex suction sidewall 12 (FIG. 3) which are spaced apart in a widthwise direction to define the hollow interior 14 therebetween. The pressure and suction sidewalls 10, 12 extend between and are joined together at an upstream leading edge 16 and a downstream trailing edge 18. The leading and trailing edges 16, 18 are spaced axially or chordally from each other. The airfoil 4 extends radially along a longitudinal or radial direction of the blade 2, defined by a span of the airfoil 4, from a radially inner airfoil platform 20 to a radially outer blade tip surface 22 of the tip 24 of the airfoil 4.

As seen in FIG. 2, two cooling fluid channel systems 26, 28 are defined in the hollow interior 14. The cooling fluid channels systems 26, 28 extend spanwise through the turbine blade 2 and are both and separate from each other in fluid communication with a supply of cooling fluid. The cooling fluid channel systems 26, 28 both pass through the airfoil 4 and along their full length between the pressure sidewall 10 and the suction sidewall 12 to transfer heat from the surfaces of the airfoil sidewalls 10, 12 to the cooling fluid and to maintain the temperature of the blade 2 below a maximum allowable temperature.

Figure 1:
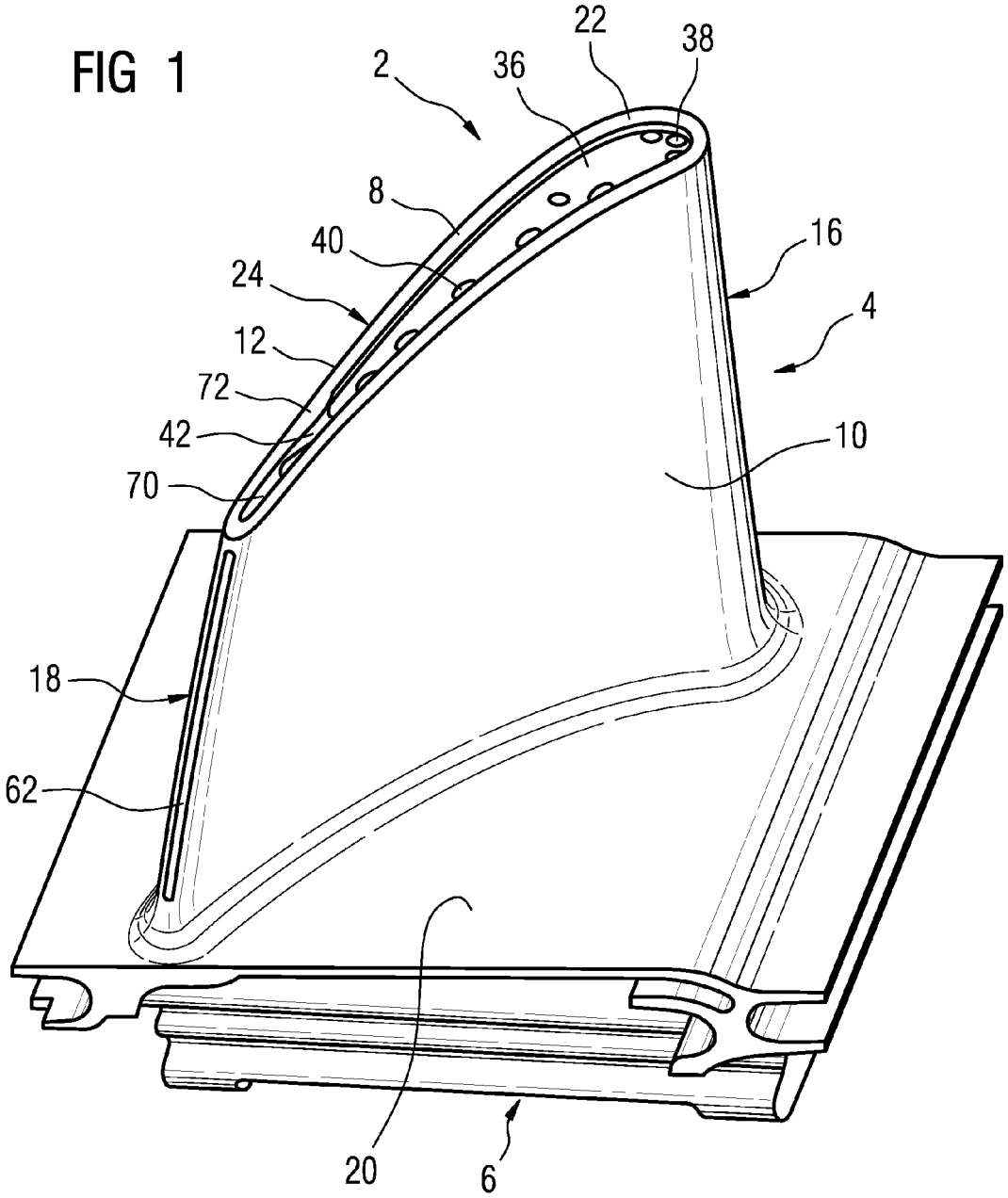
FIG. 1 shows a perspective view of a turbine blade including a root and an airfoil.

The cooling fluid channel system 26 comprises a radial channel 30 and an axial channel 32 directly following the radial channel 30 in air flow direction. The cooling fluid channel system 26 runs from an opening 34 at the radial inner end of the root 6 inside the outer wall 8 directly along the leading edge 16 directly neighbouring the leading edge 16 from the radial inner beginning of the leading edge 16 up to a tip floor 36 forming a wall parallel to the extension of the tip 24. Throughout this passage the channel system 26 is free of branches supplying all its cooling air along the leading edge 16 to the tip floor 36, and cooling the leading edge 16 very efficiently.

Along its further course the cooling fluid channel system 26, or more precise: its axial channel 32 ends in a plurality of air outlets 38, 40, 42 all arranged at the tip 24 of the airfoil 4. So, all cooling air running through the inner opening 34 into the cooling fluid channel system 26 is guided to outlets 38, 40, 42 at the top of the tip 24.

The second cooling fluid channel system 28 starts as well in an opening 44 in the radial inner end of the root 6 of the blade 2 and extends spanwise to the tip 24. However, this system 28 branches into a plurality of channels: two parallel radial channels 46, 48, a serpentine flow channel 50, a tip channel 52, a bypass channel 54, and a trailing edge channel 56. The radial channel 46 runs parallel to the leading edge channel 30 and opens into the tip channel 52 and the serpentine flow channel 50. The radial channel 48 is separated by an intercepted radial wall 58 from the radial channel 46, runs parallel to the leading edge channel 30 as well, and opens into the tip channel 52 and the serpentine flow channel 50.

The serpentine flow channel 50 begins at the end of the radial channels 46, 48 runs in two U-turns from radial outward direction to radial inward and again to radial outward, and opens into the trailing edge channel 56. The radial inner U-turn is guided by a U-turn wall 60 bordering the U-turn and turning in an angle of at least 150° from radial inward to radial outward. The trailing edge channel 56 may end in a plurality of outlets arranged in the trailing edge 18, wherein the special embodiment shown in FIG. 1 and FIG. 2 comprises only one trailing end outlet 62 formed as a radial slit and extending over 80% of the radial length of the trailing edge 18. The trailing edge channel 56 is formed like a radial passage open along its axial side to the trailing edge in the outlets, respectively the outlet 62.

The bypass channel 54 connects a root channel 64 extending from the opening 44 to the radial channels 46, 48 directly with the trailing edge channel 56 leading cooling air directly from the root channel 64 to the trailing edge channel 56. The bypass channel 54 is bent during its course from the root channel 64 to the trailing edge channel 56 opening in radial outward direction into a section of the trailing edge channel 56 which is directly situated at the outlet slit 62 of the trailing edge 18, thus opening directly to the trailing edge 18 respectively into the trailing edge air outlet 62.

The root channel 64 is located completely in the root 6 of the blade 2, thus below—which is radially inside—the platform 20. The bypass channel 64 is located with at least half of its length, especially more than ¾ of its length, below the platform 20.

For supplying the trailing edge channel 56 with sufficient cold air the most narrow channel width 66 of the bypass channel 54 is larger than half of the width of the root channel 64 from which the bypass channel 54 branches. This most narrow width is about 11% of the chord width of the airfoil, thus the length between the leading edge 16 and the trailing edge 18. In this narrowest part of the bypass channel 54 its width perpendicular to the channel width 66, so to say in the direction from the suction side wall 14 to the pressure side wall 10, is larger than the width of the bypass channel 54 in its opening region into the trailing edge channel 56 in the direction from the suction side wall 14 to the pressure side wall 10.

Inside the trailing edge channel 56 a plurality of pedestals 68 are located being surrounded by cooling air flowing through the trailing edge channel 56. The pedestals 68 are formed as round pillars connecting the pressure side wall 10 with the suction side wall 12 and transporting heat generated in the outer wall 8 into the trailing edge channel 56. The same type of pedestals 68 are located inside the serpentine channel 50 and a downstream section of the bypass channel 54, the downstream section extending about ⅔ of the total length of the bypass channel 54, whereby the number of pedestals 68 per area may be the same in the bypass channel 54 and the trailing edge channel 56.

Both cooling air channel systems 26, 28 supply outlets 38, 40, 42, 70 in the tip 24 with cooling air, however, the channel system 26 supplies only the outlets 38, 40, 42 in the tip 24 and the channel system 28 supplies at least one air outlet 70 in the tip 24 and at least one air outlet 62 at the trailing edge of the airfoil 4. The arrangement of the air outlets 38, 40, 42, 70 in the tip 24 are seen best in FIG. 3.

FIG. 3 shows the tip 24 of the airfoil 2 in a top view. The tip 24 comprises a rib 72 or protruding wall forming the radial outermost section of the outer wall 8, running completely around the floor 36 of the tip 24, and preferably rising 1%-2% of the length of the blade 2 or 2%-3% of the length of the air foil 4 above the floor 36. The floor 36 contains the outlets 38, 40 and a dust outlet 74, the outlets 38 forming a first group and the outlets 40 forming a second group. The first group of outlets 38 is arranged on the leading edge 16 and in a leading edge section 76 of the tip 24, called leading edge of the top of the tip 24 for convenience. This section 76 extends from the leading edge 16 to an imaginary line shown in FIG. 3 being perpendicular to a skeleton line 80 of the blade 2 and cutting through the upstream surface or pressure side surface 10 of the airfoil 4. In the embodiment shown in FIG. 3 this section 76 extends in a distance towards the trailing edge 18 which is 1/10 of the distance between the leading edge 16 and the trailing edge 18. The second group of outlets 40 is arranged in a pressure side section 78 of the tip 24, called pressure side of the top of the tip 24 for convenience, extending from the pressure side wall 10 to the skeleton line 80. Both group of outlets 38, 40 are fed by the first cooling air channel system 26.

The first group of outlets 38 is formed by three holes in the floor 36 all arranged directly adjacent the rib 72. The second group of outlets 40 is formed by five holes in the floor 36 all arranged directly adjacent the rib 72 as well but with wider distances between the holes than in the first group of outlets 38. The holes of the first group all have the same diameter which is smaller than the diameter of the holes of the second group. The distances of the outlets 40 to each other are not equal. The distances of the middle outlet 40 to its neighbouring outlets 40 are larger than the distances of the outermost outlets 40 of the group to their neighbour outlets 40.

Between both groups of outlets 38, 40 is an outlet free zone extending from the first group to the second group. This zone is larger—seen in the direction from the leading edge 16 to the trailing edge 18—than the diameter of the first group of outlets 38 and larger than the longest distance between holes of the second group of outlets 40.

In a trailing edge section 82 of the tip 24 extending from the trailing edge 18 to an imaginary line about 30% to the leading edge 16, as shown in FIG. 3, and being called trailing edge of the top of the tip 24 for convenience, the outlets 42, 70 are arranged. They are formed as slots or slits bordered directly by the rib 72 or protruding wall and pointing radially outward and being bevelled towards the trailing edge 18 by about 70° to the radial direction, whereby 0° is purely radial and 90° is parallel to the floor. Due to this bevelling both outlets 42, 70 are bordered radially by walls. The outlet 42 is bordered by the floor 36 and a wall 84 separating the first cooling channel system 26 from the second cooling channel system 28. The outlet 70 is bordered by the wall 84 and a wall 86 leading to the trailing edge end of the rib 72.

The invention claimed is:

1. A gas turbine blade, comprising:

a root;

an airfoil with a leading edge and a trailing edge and a tip; and a cooling air channel system extending from a cooling air opening in the root via a winding serpentine channel to a trailing edge channel at the trailing edge, the cooling air channel system including an air outlet at the trailing edge and an air bypass channel directly connecting the cooling air opening in the root with the trailing edge channel bypassing the serpentine channel, wherein the cooling air channel system comprises a radial channel opening into the serpentine flow channel as well as into a tip channel connecting the cooling air opening in the root via the radial channel with an air outlet in a trailing edge section of a radially outer blade tip surface on a top of the tip supplying the trailing edge section of the radially outer blade tip surface on the top of the tip with cooling air.

2. The gas turbine blade according to claim 1, wherein the most narrow width of the bypass channel is at least 10% of the chord width of the airfoil.

3. The gas turbine blade according to claim 1, wherein the most narrow width of the bypass channel is more than half the width of the cooling channel from which the bypass channel branches.

4. The gas turbine blade according to claim 1, wherein the cooling air channel system comprises a root channel located at least partially in the root, the bypass channel branching inside the root from the root channel.

5. The gas turbine blade according to claim 1, wherein the bypass channel is located with at least half of its length inside the root.

6. The gas turbine blade according to claim 1, wherein a plurality of pedestals are surrounded by a cooling air stream located in the bypass channel.

7. The gas turbine blade according to claim 1, wherein the trailing edge channel into which the bypass channel opens comprises a plurality of pedestals at least in the area of the bypass opening.

8. The gas turbine blade according to claim 6, wherein a number of pedestals per area is the same in the bypass channel and the trailing edge channel.

9. The gas turbine blade according to claim 6, wherein a first plurality of pedestals in the bypass channel and a second plurality of pedestals in the trailing edge channel have the same shape and size.

10. The gas turbine blade according to claim 7, wherein a first plurality of pedestals in the bypass channel and a second plurality of pedestals in the trailing edge channel have the same shape and size.

11. The gas turbine blade according to claim 1, wherein the bypass channel opens directly to the trailing edge.

12. The gas turbine blade according to claim 1, wherein the bypass channel opens into the trailing edge channel in radially outward direction.

* * * * *